US006051117A

United States Patent [19]

Novak et al.

[11] Patent Number: 6,051,117

[45] Date of Patent: Apr. 18, 2000

[54] RETICULATED METAL ARTICLE COMBINING SMALL PORES WITH LARGE APERTURES

[75] Inventors: Donald S. Novak, Chardon; Douglas J. Waskovich, Painesville; Mark L. Arnold, Chagrin Falls; Kevin J. O'Leary, Concord; Eric J. Rudd, Painesville; Thomas J. Gilligan, III, Mentor; Timothy M. Hambor, Fairport Harbor, all of Ohio

[73] Assignee: Eltech Systems, Corp., Chardon, Ohio

[21] Appl. No.: 09/076,833

[22] Filed: Nov. 5, 1997

Related U.S. Application Data

[60] Provisional application No. 60/033,330, Dec. 12, 1996.

[51] Int. Cl.[7] ..... C25B 9/00

[52] U.S. Cl. ..... 204/252; 204/284; 204/290 R; 204/290 F; 204/292; 428/566; 428/567; 428/613; 502/101; 205/161; 205/264; 205/271; 205/291; 205/333; 205/236; 205/255

[58] Field of Search ..... 204/290 R, 283, 204/284, 290 F, 292, 206, 287, 252; 429/220, 223, 233, 235, 236, 237, 241; 502/101; 428/566, 567, 613; 205/161, 264, 271, 291, 333, 236, 255

[56] References Cited

U.S. PATENT DOCUMENTS

| | | |
|---|---|---|
| 3,265,526 | 8/1966 | Beer . |
| 3,632,498 | 1/1972 | Beer . |
| 3,711,385 | 1/1973 | Beer . |
| 3,926,671 | 12/1975 | Gutjahr et al. . |
| 4,097,346 | 6/1978 | Robertson . |
| 4,343,689 | 8/1982 | de Nora et al. . |
| 4,350,580 | 9/1982 | Kadija . |
| 4,370,214 | 1/1983 | Kadija . |
| 4,515,672 | 5/1985 | Platek et al. . |
| 4,517,069 | 5/1985 | Harney et al. . |
| 4,528,084 | 7/1985 | Beer et al. . |
| 4,606,805 | 8/1986 | Bon . |
| 4,617,101 | 10/1986 | Sato et al. . |
| 4,657,650 | 4/1987 | Vauss, Jr. et al. . |
| 4,687,553 | 8/1987 | Solomon et al. . |
| 4,738,763 | 4/1988 | Abrahamson et al. . |
| 4,853,101 | 8/1989 | Hruska et al. . |
| 4,882,232 | 11/1989 | Bugnet et al. . |
| 4,923,582 | 5/1990 | Abrahamson et al. . |
| 4,978,431 | 12/1990 | Brannan et al. . |
| 5,098,544 | 3/1992 | Brannan et al. . |
| 5,183,545 | 2/1993 | Branca et al. . |
| 5,188,712 | 2/1993 | Dilmore et al. . |
| 5,300,165 | 4/1994 | Sugikawa . |
| 5,374,491 | 12/1994 | Brannan et al. . |
| 5,470,449 | 11/1995 | Bachot et al. . |

FOREIGN PATENT DOCUMENTS

| | | |
|---|---|---|
| 2114757 | 8/1994 | Canada . |
| 0 071 119 A2 | 2/1983 | European Pat. Off. . |
| WO 94 17224 | 4/1994 | WIPO . |
| PCT/US 97/20962 | 11/1997 | WIPO . |

*Primary Examiner*—Bruce F. Bell
*Attorney, Agent, or Firm*—John J. Freer; David J. Skrabec; Michele M. Tyrpak

[57] ABSTRACT

An apertured and porous metal article can find use, for example, in diaphragm or membrane electrolysis cells. The article may comprise a thin and flexible metal foam of small pores which, typically, has been perforated with large apertures. The article may also be provided with an electrocatalytic coating. It can be in substantial physical contact with a membrane or diaphragm separator used in the cell for separating anode and cathode members or compartments. There is also disclosed the preparation of the article and an electrolysis cell utilizing the resulting apertured and porous metal article.

100 Claims, 3 Drawing Sheets

RETICULATED METAL ARTICLE COMBINING SMALL PORES WITH LARGE APERTURES

CROSS-REFERENCE TO RELATED APPLICATION

This application claims the benefit of U.S. Provisional Application No. 60/033,330, filed Dec. 12, 1996.

FIELD OF THE INVENTION

The present invention relates to reticulate metal articles having both small pores and large apertures. Generally, the articles can be useful, such as in electrolytic cells, where an electrical current is impressed on the article. When so employed, they may be typically utilized as inserts coupled with electrodes, or as current collectors or current distributors.

BACKGROUND OF THE INVENTION

Electrodes have been known which can be foraminous in structure. U.S. Pat. No. 4,370,214 describes an electrode prepared from filaments or fibers affixed to a support fabric. Metal is then deposited on the filaments, as by electroplating, which can result in a highly porous reticulate electrode. Such an electrode offers the advantage of a high surface area. In a related teaching in U.S. Pat. No. 4,350,580 there is disclosed a high surface area structure as a current distributor.

Battery electrodes may be made starting with a foam substrate material that is metallized. The polymer foam substrate of the metal foam can then be removed leaving a foam metal article. For example, U.S. Pat. No. 5,374,491 discusses an electrode produced from a raw material polymer foam in strip form which is electroplated. The thus obtained metallized foam may have the polymer substrate thermally decomposed and the metal annealed in a reducing atmosphere to obtain a reticulated metal sheet. The resulting reticulate article lends itself to high performance electrodes, especially as a high capacity, long life battery electrode.

The porous article with polymer substrate may not have the substrate removed, and may additionally contain other substituents. Such an article can find use as a flow-through electrode in removal of metal ions from a waste water stream, as described in U.S. Pat. No. 4,515,672. The reticulate cathode electrode is formed from an electroplated open cell polyurethane foam containing conductive carbon particles. The resulting reticulate article may be, for example, a copper plated cathode with the conductive carbon particles being retained in the final article.

Porous reticulates may also be formed using an open cell organic synthetic resinous material or an inorganic refractory material. For example, it is taught in U.S. Pat. No. 4,517,069 that a reticulate of titanium hydride may be produced by coating an open cell organic or inorganic substrate material, e.g., polystyrene beads serving as a "pore-former", with a slurry of titanium hydride particles and binder. The pore-former is removed, leaving the $TiH_2$ reticulate. This reticulate can be sintered to yield a titanium metal reticulate. The reticulate may have a combination of large pores imparted by the substrate material in combination with micropores resulting from sintering effects. The reticulate has been taught to be effective as an electrode in an electrolytic chlor-alkali cell.

A reticulated electrical interface material may also be imposed between an electrode and a current distributor.

Such a conductive interface material can be a compressible reticulated article, as taught in U.S. Pat. No. 4,657,650. The reticulate article provides for a multiplicity of contact points between the faces of the electrode and the current distributor, thereby enhancing electrical connection.

It has also been taught to use a fine screen foraminous material in conjunction with coarse screens as current distributors in electrolytic cells. Thus, U.S. Pat. No. 4,343,689 describes a coarse mesh cathode distributor screen having a finer mesh screen applied thereon. Such an arrangement provides a multiplicity of electrical contacts, such as to a particulate electrode that is bonded to a membrane.

It would, nevertheless, be desirable to provide an electrolytic cell with reduced cell resistivity, improving voltage savings. It would also be advantageous to enhance cell current efficiency. It would be advantageous to provide enhanced properties in a variety of processes, such as can be carried out in electrolytic cells, including chlorine and caustic production and salt splitting.

SUMMARY OF THE INVENTION

There has now been found an assembly which can be utilized, for example, in an electrolytic cell for providing reduced cell voltage. This can be obtained together with enhanced current distribution in the cell. Moreover, electrolytic cell operating life can be extended. Also, there is now provided a method for reactivation of electrolytic cells in the field with field-replaceable electrode insert members, thereby enhancing overall cell operating efficiencies as well as economics of operation.

In one aspect, the invention is directed to an apertured and porous metal article, which article is a three dimensional reticulated metal article consisting of a network of pores and interconnecting pore boundary material, such article having, in addition to the porosity of the pores within the article, a multitude of apertures through the article, which apertures through the article are enlarged over the size of the pores within the article. The article may serve as a current collector. The article may also serve in an electrolytic cell and be coated, in whole or in part. Representative coatings can include electrocatalytic coatings or coatings such as an activated nickel coating.

In another aspect, the invention is directed to a method of preparing a metal article, which article is a three dimensional reticulated metal article consisting of a network of pores and interconnecting pore boundary material, such article having, in addition to the porosity of the pores within the foam, a multitude of apertures through the metal article, which apertures through the article are enlarged over the size of the pores within the foam, which method comprises:

(1) establishing a three dimensional precursor article of open-pore substrate material having continuously connecting pore boundary material;

(2) providing apertures through the precursor article, which apertures are enlarged in size over the size of the pores within the substrate material; and (3) metallizing the substrate material of the precursor article, preparing an apertured, three dimensional reticulated porous metal article;

with the proviso that the metallizing of step (3) may precede the providing of large apertures of step (2).

In a still further aspect, the invention is directed to an electrolytic cell comprising a separator member arranged between anode and cathode electrode members, with the separator member being in contact on at least one broad surface thereof with the hereinbefore described apertured and porous metal article.

In yet another aspect, the invention is directed to the method of refurbishing an electrolytic cell having a separator member arranged between anode and cathode electrode members, which method comprises:

(1) separating such separator member within the cell from at least one electrode member contained within the cell;

(2) inserting between the resulting separated electrode member and separator member the above described apertured and porous metal article; and (3) engaging the separator member and the electrode member with the apertured and porous metal article positioned therebetween.

In another aspect, the invention is directed to a unitized porous metal article in sheet form having a reticulated, very openly porous layer free from apertures through the layer, which layer is metallically bonded to an apertured and porous metal layer of finely porous material, each layer consisting of a network of pores and interconnecting pore boundary material with the apertured and porous metal layer having apertures through the layer enlarged over the size of the fine pores within the layer.

An aspect of the invention is also directed to a unitized porous metal article in sheet form having a separator member formed on an apertured and porous metal article, which article is a three dimensional reticulated metal article consisting of a network of pores and interconnecting pore boundary material, such article having, in addition to the porosity of the pores within the article, a multitude of apertures through the article, which apertures through the article are enlarged over the size of the pores within the article.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENTS

Figure 1:
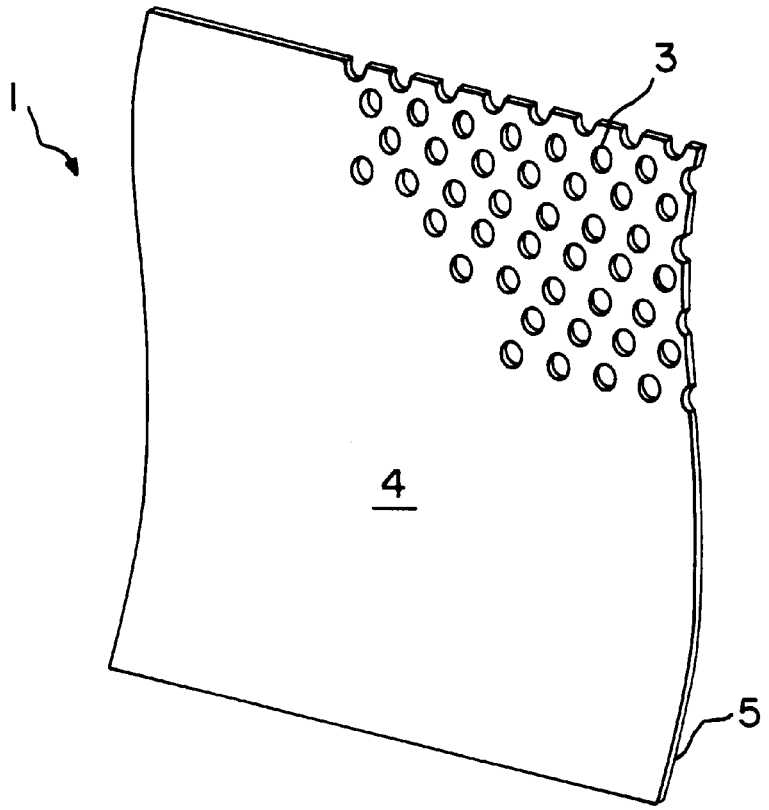
FIG. 1 is an oblique view of an apertured as well as porous metal article representative of the present invention.

The apertured and porous metal article can be made from items which by their nature are porous, such as articles of metal fibers matted together, which include felts, or such materials as may be loosely woven, including gauzes, and fibrous masses, such as metallic wools. The article may be made of materials which include meshes and the like, such as the metallic porous article made from mesh sheets and non-woven fabric sheets that can be layered together, as disclosed in U.S. Pat. No. 5,300,165. The apertured and porous metal article can also be an article that starts with a porous, usually non-metallic reticulate substrate material, e.g., a polymeric foam, as a precursor material. This reticulate substrate precursor material can be metallized to produce a porous metal article. Methods of producing such an article will be more particularly discussed further on hereinbelow. Regardless of the specific form of the porous article or the production method of producing the porous article, it will usually be referred to herein for convenience simply as the "porous metal article". By being porous, it is meant that the article will readily permit flow of electrolyte through the thickness dimension of the article under a small difference of hydrostatic pressure, e.g., a difference of about 1–3 inches of electrolyte, which difference is across the thickness dimension of the article when the article is in a representative sheet form, with the sheet having a thickness within the range of from about 1 to about 10 millimeters.

Where a reticulate substrate precursor material is used in preparing the porous metal article, such precursor material is preferably an open-cell three dimensional material such as a foam. This material has thin walls as pore boundary material which will define the pores of the final porous metal article product. In articles such as gauzes and felts, the pore boundary material may take the form of filaments, or fibers, or strands, each of which is usually referred to herein for convenience simply as "strands." Not all pore boundary material, as strands of a gauze or thin walls of a foam, need be connected, but preferably the pores are defined by continuously connected material for enhanced electrical conductivity of the article. Such an article may be referred to herein as having "open interconnected cells". For convenience when referring to the porous metal article, the words "pore" and "cell" are used interchangeably, e.g. "open-cell" equates with "open-pore".

Since the size of the pores are each defined by pore boundary material, and since the pores interconnect through at least the thickness dimension of the article, when it is in sheet form, to provide the article porosity, the pores are contained within the article. They are thus small. Contrasted to this, the apertures of the apertured and porous metal article are too large to be defined by the boundary material of a single pore. Moreover, the apertures are not interconnected through the thickness dimension of the article in sheet form. Each aperture individually penetrates completely through the thickness of the article, rather than interconnecting through the article. Comparatively, the apertures are large.

Whether or not the apertured and porous metal article is produced such as from a non-metallic reticulate substrate material, e.g., a polymer foam, the metal article first obtained may be an intermediate metallized article that has pores within the article but may not as yet have the apertures through the article. This intermediate metallized article without apertures can then be provided with apertures. Alternatively, it is within the scope of the invention that first a porous substrate precursor material such as a polymeric foam can be provided with both pores within the precursor material as well as with apertures through the material, then this article is metallized. Also, a combination of these operations may be employed, i.e., providing of apertures through a pre-metallized substrate precursor material, as well as subsequently making apertures through the subsequently metallized product.

Hence, in preparing the apertured and porous metal article the apertures in the article are introduced into either a precursor material or the porous metal article itself, or in both. These may be introduced by any conventional or suitable manner for penetrating a thin, porous sheet material including machining, pressing, embossing, and the like.

Obtaining the apertures by using pore-forming material is also contemplated. In a preferred embodiment, a die and punch type perforating machine is used to produce the apertures through the article. Because of this, the apertured and porous metal article may be referred to herein for convenience as the "perforated metal article", and the apertures as "perforations" and the like, e.g., there may be discussed the "perforating" of the metal article regardless of the means of obtaining the apertures. In a perforating machine, the porous article can be fed through the machine by a series of top-and-bottom rollers positioned at both the feed and exit ends of a die.

Referring then to the figures, FIG. 1 shows an embodiment of an apertured and porous metal article 1 in a representative sheet form. In such sheet form, the article 1 has a major front face 4 as well as a major back face 5. In addition to the pores 2 (FIG. 3) within the sheet, the sheet is perforated through the article 1 with a multitude of apertures 3, which are depicted on a portion only of the sheet but, as will be understood, can extend across the whole face 4 of the sheet.

Figure 1A:
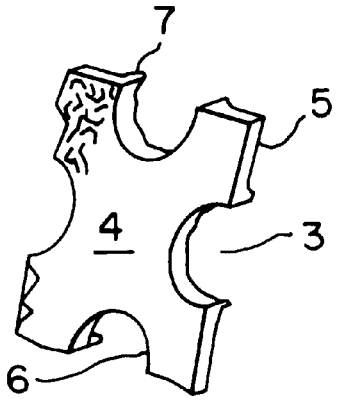
FIG. 1A is an enlarged partial sectional view of a portion of the apertured and porous metal article of FIG. 1 depicting smooth and rough edges for apertures of the article.

As seen then in FIG. 1A, depicting an enlarged portion of the apertured and porous metal article 1 as embodied in FIG. 1, it will be seen that, at the apertures 3, there can be a smooth edge 6 on the front face 4 of the article, but a rough, projecting edge 7 around the apertures 3 at the back face 5 of the article. Such a configuration of a smooth front face 4 and rough back face 5 may be obtained, for example, by perforating the article from the front face 4 through to the back face 5. By this procedure, the porous metal material which is displaced by the perforations 3 is pushed out and extended at the back face 5 to provide the rough projecting edge 7 around the apertures 3.

Figure 2:
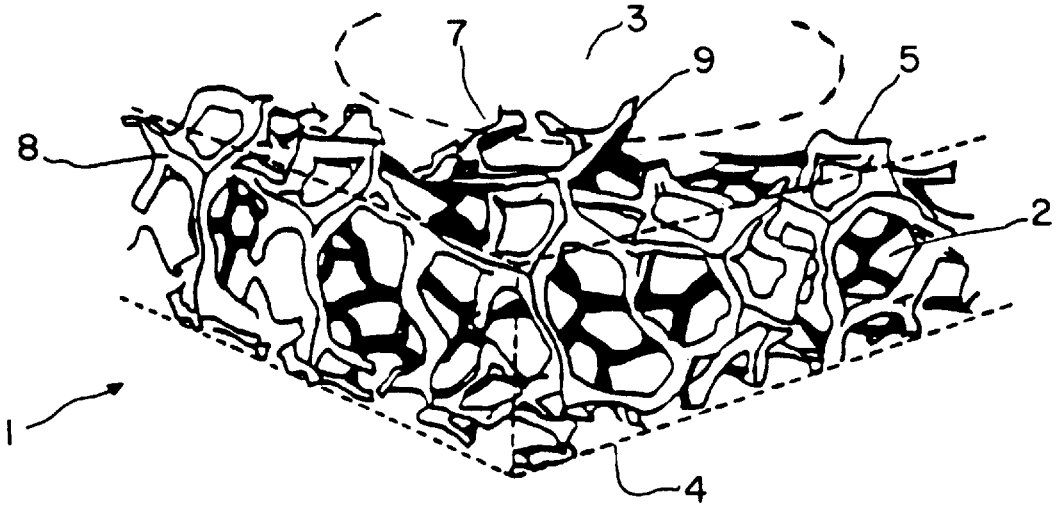
FIG. 2 is an enlarged perspective view in partial section of a corner of the apertured and porous metal article of FIG. 1 depicting a perforation in partial section with rough edge.

In FIG. 2 there is then depicted a greatly enlarged portion of a corner of the embodiment of the apertured and porous metal article 1 as depicted in FIG. 1. As will be seen in the FIG. 2, the article 1 is a reticulated foam of interconnected, open-pore small pores 2 and a pore boundary material of continuously interconnected strands 8. The strands 8 provide a network of open pores 2 within the article 1. The bottom of this corner section of the article 1 is a smooth front face 4. Opposite the front face 4, there is depicted by dashed line on the back face 5 the top of an aperture 3 that extends through the article 1. This aperture 3 has been provided in the section by punching up through the article 1. Thus, around the top of the aperture 3 there are outwardly projecting strands 9 that project from the face 5 to provide a rough edge 7. By use of the terms herein such as "rough back face 5" or "at least substantially rough major face" it is meant to include a face which may have outwardly projecting pore boundary material as represented by the strands 9, some to all of which may project upwardly from around apertures 3. Conversely, the use herein of the terms such as a "smooth front face 4" or "at least substantially smooth major face" refers to a face 4 that will be free, or at least virtually free, of outwardly projecting pore boundary material such as strands 9. For this apertured and porous metal article 1, although there will be a multitude of apertures 3 on a face of the article 1, e.g., the back face 5, the number of these apertures 3 will generally be expected to be much less than the number of pores 2 on the article face, as can be appreciated by reference to FIG. 2.

Figure 3:
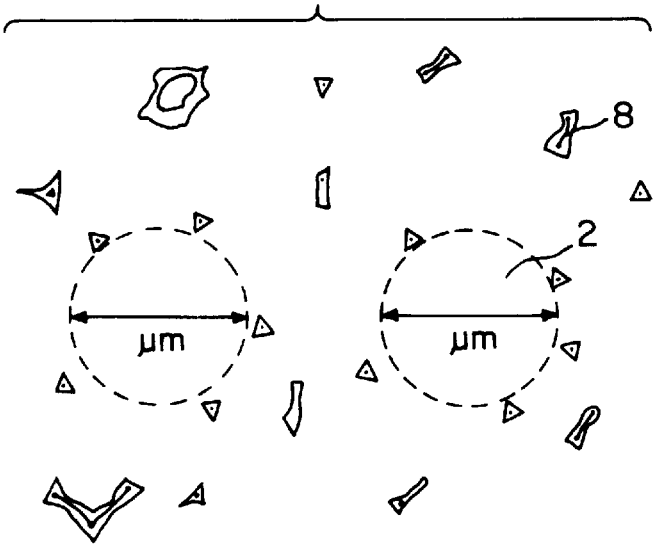
FIG. 3 is a magnified sectional view of a portion of a porous metal sheet, showing pore size.

In FIG. 3, there is then depicted a small section of the porous metal only, i.e., without apertures, depicted in cross-section and with magnification. In the section in FIG. 3 there can be seen a multitude of profiles of the metal strands 8 of the metal article. In a metal foam article, which is a preferred porous metal article, these strands 8 can have a thickness within the range of from about 10 microns to about 120 microns. Within the open areas between the metal strands 8 are the pores 2. In FIG. 3, where the positioning of the strands 8 has permitted, representative pores 2 which are circular in cross-section have been shown. For pores that are at least substantial spheres, the diameter, shown in the figure as an arrow across a dashed line circle with the legend "$\mu$m" under the arrow (designating that the pore diameter may be measured in microns), represents the "pore size" for the pores, as such term is used herein. This diameter is also the largest internal pore dimension for these pores. Often, the metal article will be found to have pores which are anisotropically dimensioned. These pores are typically oval, with diameters which are longer in one direction. The long diameter of the pore oval is thus the largest internal pore dimension for these pores, which dimension may also sometimes be referred to herein as the "longest" pore dimension.

The article as a preferred porous metal foam article can have an average number of pores per inch that is within a wide range, typically within a range of from about 5 to about 120 pores per inch (ppi). An application of the preferred porous metal foam article can be in an electrolytic cell as a member which is inserted in a cell and coupled with an electrode of the cell. This application may be referred to herein as an "electrode insert member." For this application, the porous metal can have a ppi also ranging from about 5 to about 120 ppi. This will equate to pores 2 typically having sizes ranging from about 200 microns to about 500 microns in largest internal pore dimension. However, when used as a current collector, the article may more typically have ppi ranging from about 2 ppi to about 100 ppi. Within these ranges, a porous metal foam of particular interest to prepare an article useful as an electrode or as a current collector, is a reticulated, very openly porous material having pore size ranging from about 5 to about 30 ppi. But most typically, for economy, a preferred porous metal foam article will have pores ranging in size from about 20 ppi to about 110 ppi.

The apertured and porous metal article 1, as depicted in FIG. 1, will usually be in sheet form, i.e., have a thickness dimension which is less than its width or length. The sheets may comprise layers such as of mesh and non-woven fabric sheets, for example, as disclosed in U.S. Pat. No. 5,300,165. A representative article in sheet form will be more particularly discussed hereinbelow in connection with FIG. 4. Even the sheets themselves may take various forms, e.g., coiled or strip form, and the forms can be utilized in varying arrangements. Thus, the sheets in strip form can be interconnected, in the manner of a grid or network. However, it is to be understood that the invention is also directed to utilizing apertured and porous metal articles which are in other forms, e.g., articles in a form like a block or a board, which forms in cross-section may be rounded, e.g., elliptical or circular, or multi-sided, such as triangular or rectangular.

The apertures 3 through the porous metal article 1 may be any of a variety of shapes including shapes which at their periphery are rounded, e.g., circles or ovals, as well as shapes which are multi-sided, including triangles, squares, rectangles and the like, such as octagons. They are apertures 3 through the foam article 1 which may be made by perforating holes through the article 1, and as noted hereinbefore, the apertures 3 may be referred to simply as perforations 3. Any shape may be employed for each aperture 3, but it is advantageous that they all have the same size for economy. Although other patterns are contemplated, it is, moreover, also advantageous that in any one sheet the apertures 3 all be of the same shape for economy. It is preferred that the apertures 3 have an oval or at least somewhat oval shape, e.g., almond-shaped and pointed at one or both ends. In an application where the metal article 1 will be involved in a gas release process, as where the article 1 is engaged against a cathode of an electrolytic cell and hydrogen gas will be released at the cathode, it has been found to be serviceable to have the upper surface of the apertures 3 be rounded in shape.

As mentioned hereinbefore, the apertures 3, which extend through the porous metal article 1, are enlarged over the size of the pores 2, which are within the article. This size differential is such that the pores 2 have a longest internal dimension which is shorter than the shortest dimension of the apertures 3. Typically, the shortest dimension of the apertures 3 is within the range from about 0.5 mm. to about 5 mm. Where it would be advantageous for the apertures 3 to be primarily rounded in shape, e.g., oval in cross section, the diameter across the short way of the oval can be the shortest dimension of the aperture 3 and can generally be in the range from about 1 mm. to about 10 mm. For a preferred porous metal foam article 1 having from about 5 to about 120 ppi, this results in a ratio of the shortest dimension for the apertures 3 to the longest dimension for the pores 2, which is within the range from about 1:1 to about 5:1.

These apertures 3 are usually introduced into the metal article 1 in an arrangement which provides an at least essentially even distribution of apertures 3 across the face 4 of the article 1. It is advantageous, such as for maintaining uniform strength in the article 1, that the apertures 3 have an at least substantially uniform distribution. It is preferred for best strength of the overall article 1 that the arrangement be hexagonal, although other patterns of apertures 3, e.g., triangular, rectangular or square are contemplated. Typically, for an article 1 such as depicted in FIG. 1, the average number of apertures 3 in the article is within the range from about 30 to about 100 apertures 3 per square inch of the front face 4 of the article 1. Generally, when the term "multitude of apertures" is used herein, such is meant to include a metal article 1 having an average number of apertures 3 within the foregoing range. Usually, from these apertures 3, the open area of the face 4 will be from about 10% to about 75% of the total area of the face 4. The amount of open area on the face may be varied in accordance with several factors, e.g., to maintain a stronger article 1, the percent of open area will be typically below about 40 percent. It is desired that all the apertures 3 penetrate completely through the article 1. The apertures 3 can be introduced into the article 1 to provide smooth faces for both the front face 4 and back face 5 of the article 1. Also, the article 1 may be finished as by calendaring, to provide a smooth face on both major faces 4, 5 of the article. Also, both such faces 4, 5 can be rough faces, where desired.

As mentioned hereinbefore, the apertured and porous metal article 1 may be produced by starting with a porous precursor material and then providing apertures to the material. The final apertured and porous metal article 1, which may sometimes be referred to herein for convenience simply as the "apertured metal article", is advantageously produced using a reticulate starting precursor material as a substrate. Any of a great variety of substrate precursor materials, including substrate materials in different forms, can be utilized. Included as substrate precursor materials are polymeric foams, carbon or graphite foams, silicate foams and other organic or inorganic open-cellular materials. Synthetic or natural fiber foams, including flexible paper or wood products, and leather can also be useful. For purposes of the present invention, the term "reticulated material", when referring to a substrate, shall include all such substrate materials.

Useful polymeric foams are particularly advantageous as the substrate reticulated material for economy. Those which may be employed include any of those polymeric foams such as polyurethanes, including a polyether-polyurethane foam or a polyester polyurethane foam; polyesters, olefin polymers, such as a polypropylene or polyethlyene; vinyl and styrene polymers, and polyamides. Examples of commercially available preferred organic polymer substrates include polyurethane foams marketed by Foamex International, Inc., including polyether-polyurethane foams, and polyester polyurethane foams.

It will be understood that non-foam materials may also be employed as substrate materials. Filaments, including fibers or threads, may serve as a substrate for the deposition of an electroconductive metal, as disclosed in U.S. Pat. No. 4,370,214. An open-cell organic or inorganic foam or sponge, prepared using a "pore-former", e.g., discrete "pore-former" beads, pellets and the like, has been disclosed in U.S. Pat. No. 4,517,069. Such technique can be utilized in making a metal foam precursor which may be converted to a metal foam, such as a titanium metal foam, as by heat application.

The substrate reticulate material may have some electrical conductivity. For a polymer foam, this can be achieved by employing any of a number of well-known procedures such as coating with a latex graphite; coating with a metal powder as described in U.S. Pat. No. 3,926,671; electroless plating with a metal such as copper or nickel; sensitizing by application of a metal such as silver, nickel, aluminum, palladium or their alloy as described in U.S. Pat. No. 4,370,214; coating with an electrically conductive paint, e.g., a paint containing carbon powder, or a metal powder such as silver powder or copper powder; coating of a pore-former as described in U.S. Pat. No. 4,517,069; and vacuum deposition of a metal by cathode sputtering with a metal or alloy as disclosed in U.S. Pat. No. 4,882,232. One suitable electroless plating process is disclosed in the EPO published application 0 071 119. Particularly preferred polyurethane foams which are made conductive by coating with a latex graphite are commercially available and are marketed by Foamex International, Inc. These foams typically have a conductivity of about 0.006×1/[ohms·centimeters].

A continuous production process for preparing a preferred porous metal article in sheet form using an open-cell foam plastic sheet as a starting material, and using electroplating in the process has been taught in U.S. Pat. No. 4,978,431. In addition, U.S. Pat. No. 5,300,165 proposes a similar method for the manufacture of metallic porous sheets from mesh sheets and non-woven fabric sheets, which can be layered together. The electroplating bath can be any of a number of conventional electroplating baths capable of electroplating a variety of metals. Such metals include, by way of example, nickel, chromium, zinc, copper, tin, lead, iron, gold silver, platinum, palladium, rhodium, aluminum, cadmium, cobalt, indium, vanadium, thallium, and gallium. Alloys can be plated, such as brass, bronze, cobalt-nickel alloys, copper-zinc alloys and others. Some metals are not susceptible to electrodeposition from an aqueous medium. For example, aluminum and germanium are most commonly electrodeposited from an organic bath or a medium of fused salt. Where a preferred porous metal article is made and electroplating of an open-cell foam is involved, the plating is often nickel plating and the resulting porous nickel sheet will generally have a weight within the range of from about 300 grams per square meter, up to about 5,000 grams per square meter, of a major face of the article 1. More typically, this will be a sheet weight within the range of from about 400 to about 2,000 grams per square meter. For the above mentioned reticulated, very openly porous material, the nickel plating weight will generally be between about 1,000 and about 2,000 grams per square meter of a major face of the article 1.

Other methods may be employed for the deposition of metal onto the substrate reticulate material to provide the porous metal article. These may include methods, which have been discussed hereinabove, that are also useful to achieve some initial electrical conductivity. Thus, application of a metal powder can be employed, as disclosed in U.S. Pat. No. 3,926,671. Also, both chemical and physical vapor deposition techniques can be used, and the chemical vapor deposition method can be such as disclosed in U.S. Pat. No. 4,882,232.

Generally, if electroplating has been utilized, after the completion of the plating, the resulting metallized article can be washed, dried, and may be thermally treated, e.g., to decompose a polymer core substance. In some instances, the article may be annealed, such as in a reducing or inert atmosphere. Regarding thermal decomposition, the specification of U.S. Pat. No. 4,687,553 suggests a multi-stage heat decomposition method. According to the patent, when nickel is plated, thermal decomposition is conducted at a temperature in the range of about 500°–800° C. for up to about 3 hours depending on the plastic foam (polymer) used. Annealing can be carried out by an ordinary method. For example, in the case of nickel, it is carried out in a hydrogen atmosphere at a temperature in the range of from about 800° C. to about 1200° C. for up to about 30 minutes.

Figure 4:
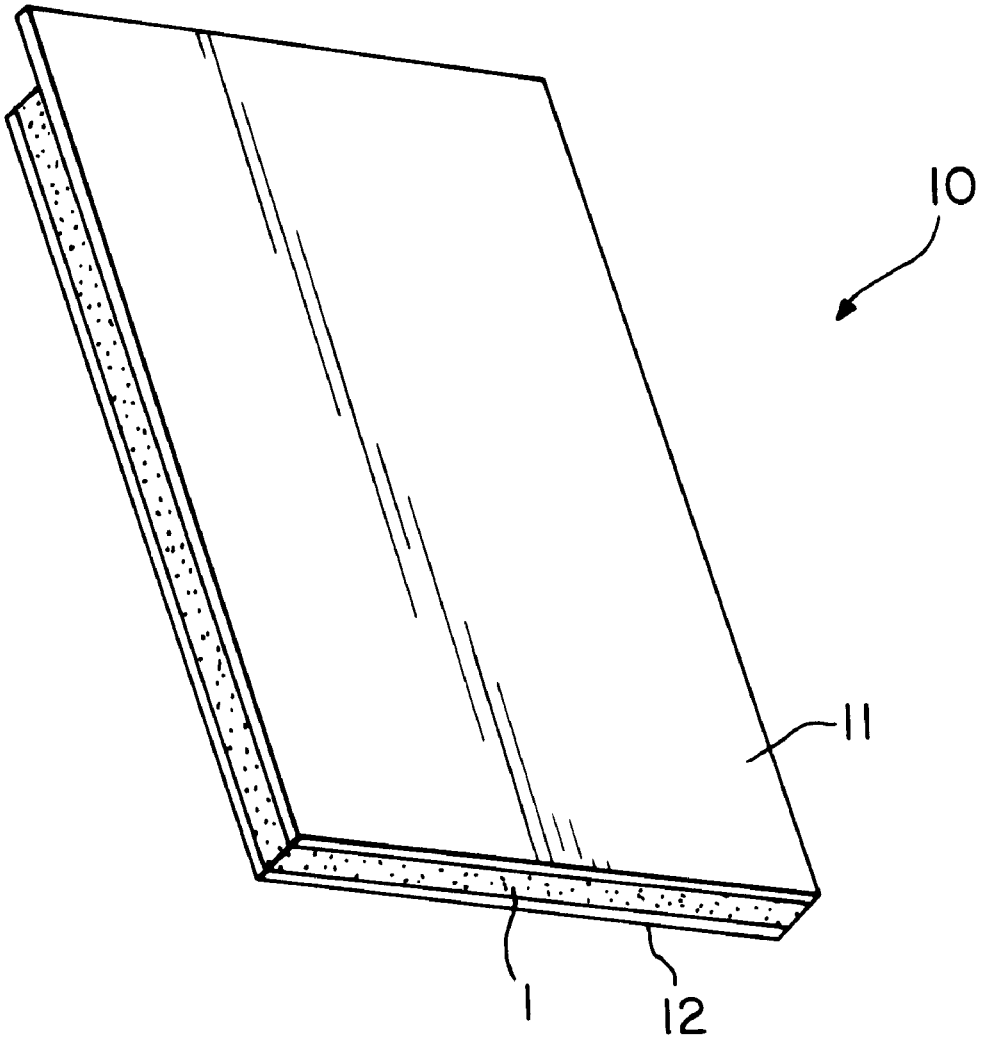
FIG. 4 is a perspective view of an assembly, such as useful in an electrolytic cell including the apertured and porous metal article of FIG. 1 in assembly with an electrode member plus a separator member.

The apertured and porous metal article 1 can then have particular application in an electrolytic cell. In this regard, and referring again to the figures, FIG. 4 illustrates an embodiment of the present invention as it relates to electrolytic cell construction. The figure shows an electrolytic cell assembly 10 consisting of an electrode member 11 spaced apart from a separator member 12. An apertured and porous metal article 1 is interposed in the space between the electrode member 11 and the separator member 12. In this embodiment, each of the electrode member 11, separator member 12 and the apertured and porous metal article 1 are in sheet form. This permits broad facial contact between the individual elements. However, other forms, e.g., hairpins, and other convoluted shapes are contemplated.

In a typical electrolytic cell arrangement represented by the FIG. 4 embodiment, the thickness of the apertured porous metal article 1 in sheet form is generally between about 0.1 mm. and about 10 mm. Use of a sheet having a thickness of less than about 0.1 mm. would not be advantageous because of insufficient mechanical integrity of the sheet to insure desirable electrical contact such as between the sheet and a facing electrode member 11. Usually, the metal article 1 will have a thickness of from about 1.5 mm to about 3 mm and have pores per inch ranging from about 40 to about 80 ppi. Another metal article 1 of particular interest can be based on the above-mentioned reticulated, very openly porous material which has an average number of pores per inch within the range of from about 5 to about 30 ppi and which can have a thickness in sheet form of typically from about 5 mm. to about 10 mm. A porous material that can be made to generally coincide with these parameters has been shown, for example, in U.S. Pat. No. 4,657,650.

The apertured and porous metal article 1 is disposed between the electrode member 11 and the separator member 12 such that the at least substantially smooth face 4 of the article 1 is in contact with the separator member 12 and the at least substantially rough face 5 is in contact with the electrode member 11. This smooth face 4 of the article 1 may be a calendered surface to reduce, or eliminate, outwardly projecting pore boundary material such as strands 9 which can act as burrs that might cause rupturing or tears in the separator member 12. Pressure may then be applied to the assembly 10 so that the metal article 1 is compressively urged into direct contact with the separator member 12 so as to provide a zero gap configuration, except at the apertures, since there will be no direct contact there. Such an arrangement, including firm engagement of the rough face 5 of the article 1 with the electrode member 11, provides lower resistance and voltage loss between the article 1 and the electrode member 11, due to greater area of contact and even distribution of contact. To enhance obtaining a zero gap configuration, as well as enhance a greater area of contact, there can be used a soft, readily compressible article 1, e.g., as provided by a gauze or a felt prepared from metallic fibers, which materials may provide springy major faces to the article 1.

The separator member 12 may also be bonded to the metal article 1. For this the separator member 12, e.g., as a membrane film or a diaphragm could be formed on the separator member 12. For example, deposition of diaphragms onto porous substrate surfaces is well known and has been disclosed, such as in U.S. Pat. No. 4,410,411. Usually, a slurry of fibrous material is used along with a vacuum deposition operation to provide the diaphragm on the porous substrate surface. By such techniques, unitized structures can be prepared which may be used as a unit, such as by direct insertion into an electrolytic cell. A representative unitized structure can have a diaphragm as the separator member 12 deposited on the metal article 1 and this resulting structure could be inserted in a cell to form the sandwich article 10 as shown in FIG. 4. Prior to forming this unitized structure, the metal article 1 could be a coated article 1, including such article as has an asymmetric coating, which coatings will be more particularly described hereinbelow.

Where the apertured and porous metal article 1 is a coated article, such a coating may be an electrochemically active coating. Such coatings are further described hereinbelow. These coatings can include the coatings that are typically provided from platinum or other platinum group metals, which are often used for coating a valve metal substrate. Such electrochemically active coatings are most particularly described hereinbelow. Representative of such a coating is a platinum and ruthenium metal coating which can typically be applied to the metal article 1 by application of the metals as their chloride salts in solution, such as by dip coating the metal article 1 into such solution followed by baking. Other coatings for the metal foam article 1 can include those which are more particularly associated with preparing coated cathodes for use in electrolytic cells. A representative coating would be an activated nickel coating, e.g., a Raney nickel coating formed from nickel aluminum alloys. Such coatings are also discussed hereinbelow, including a description in connection with the examples.

The coatings may be applied to the apertured and porous metal article 1 by any method conventionally used for applying coatings to a metal substrate. As has already been mentioned hereinbefore, the coating may be applied from a liquid medium, typically containing a salt of a metal that is desired in the coating, with a dip coating being a representative application means. Coatings may be applied by electrolytic techniques including electroplating. For example, a nickel-plus-zinc coating can be electroplated onto the metal article 1, then the zinc removed such as by leaching, to form an activated nickel coating. Where leaching is used with a nickel-plus-aluminum coating, the coating can be obtained by applying aluminum in sheet form, e.g., foil form, against a nickel metal article 1 and heating. Such operation can fuse the aluminum into, for example, a porous nickel article 1 and provide an alloy, intermetallic mixture, or, in the case of nickel and aluminum, a nickel-aluminum compound such as nickel aluminide. Then the aluminum can be leached to form an activated nickel coating.

Other coating techniques include both chemical and physical vapor deposition techniques. A suitable coating may also be applied to the metal article 1 by a thermal spray deposition technique such as plasma spray. Representative applications could include the plasma spraying of nickel-aluminum, or chemical vapor deposition of a titanium coating on an apertured and porous nickel substrate. Chemical vapor deposition of a titanium coating, such as on a copper or a nickel article 1, can be useful to prepare an article 1 that may be utilized on the anode side of an electrolytic cell. Thus, the titanium coated article 1 could be engaged between an anode and a separator and participate in providing enhanced gas release such as when employed in a chlor-alkali cell. Moreover, such an article 1 can also be contemplated for use as an anode. It is to be understood that even a nickel metal article 1 might be useful on the anode side of a cell, as in the alkaline conditions that can exist at the anode side in water electrolysis.

It is also contemplated that, for coating, the metal article 1 could be placed in an electrolytic cell, e.g., a chlor-alkali cell, and metal ions for the coating could be in the electrolyte of the cell. Passage of electric current through the cell can then result in an in situ deposition in the cell of a plated metallic coating of these metal ions on the metal article 1. Such a coating technique has been shown, for example, in U.S. Pat. No. 4,160,704, which relates to a membrane type chlor-alkali electrolytic cell. After such in situ coating, the coated metal article 1 can be retained in the cell during cell operation, e.g., cell operation including operation of a chlor-alkali cell, which cell may be of the membrane type.

Although uniformity of coating on the metal article 1 is contemplated, it will most often be useful to provide an asymmetric coating on the article 1. By being asymmetric, as the term is used herein, it is usually meant that the coating will be non-uniform through the thickness dimension of the article 1. As an example, the totality of a major front face 4 of such article 1 may be coated and that coating then gradually diminish through the thickness of the article 1 whereby the major back face 5 of the article 1 contains no coating. However, any non-uniformity of coating as would be considered by those skilled in the art is meant to be included by the use of the term "asymmetric coating" herein. It contemplated that there could be a coating on the front face 4 of the article 1, with a different coating on the back face 5 of the article 1.

It is contemplated that any means for applying a coating to the metal article 1 may be useful for providing an asymmetric coating on the article 1. Thus, for example, thermal spray application of a coating may be applied such as only to a major front face 4 of the article 1. Or a liquid media containing a coating precursor material which can, for example, be applied and baked, can be applied by a roll coating operation to a major front face 4 of the article 1 whereby the face 4 of application will be thoroughly coated and the obverse face, e.g., a back face 5, will receive little or no coating. Although not limited to application for providing an asymmetric coating, but an application technique which can be particularly suitable for such an outcome, is a gravure roller process. Application of coating composition by gravure roll may be particularly desirable in a continuous coating process. The gravure roll need not directly apply a liquid coating composition to the metal article 1, but may rather apply such composition to a spreader roll which then applies the composition to the article 1. such operation, or any like operation involving the gravure roll as is useful for applying liquid composition to a substrate, is contemplated to be useful herein.

It can be highly serviceable to provide an asymmetric coating to the article 1 where the article 1 will serve in a "sandwich" as shown in FIG. 4. In this type of an arrangement where the electrode member 11 is a cathode and the separator member 12 is a membrane separator, it can be desirable to coat the face of the apertured and porous metal article 1 which will be in contact with the membrane separator. In such an arrangement where, for example, there is a steel cathode and a nickel foam apertured and porous metal article 1, an asymmetric coating which will thoroughly coat a face of the article 1 can be the face that will be in contact with the membrane separator. Thorough, uniform coating of the entire nickel foam article 1 in such installation may not offer a highly desirable voltage savings in an electrolytic cell, when compared to an asymmetric coating, and therefore can be uneconomical. In general, asymmetric coating as opposed to thorough, uniform coating of the metal article 1 can be useful, although in some applications of the metal foam article 1, such can serviceably employ a uniform, thorough coating of the article 1.

Coating weights, such as for asymmetric coatings, can generally vary within the range from as little as about 2, up to about 2,500 grams per square meter of the surface of a major face of the metal article 1. Use of less than about 2 grams per square meter can be insufficient for providing readily discernible enhancement of desirable cell characteristics, while greater than about 2,500 grams per square meter can be uneconomical. Usually, for best economy coupled with desirably enhanced cell operating characteristics, a coating will be present on the article 1 in an amount within the range of from about 5 to about 2,000 grams per square meter of a major face of the article 1.

An electrolytic cell arrangement such as the assembly 10 of FIG. 4 is especially useful in that it may be assembled at a cell site or within a cell, e.g., in a filter press electrolyzer. For example, during cell shut down, where a separator member 12 and an electrode member 11 are separated, a metal foam article 1 can be inserted between the members 11, 12. Or, a preassembled unit of separator member 12, electrode member 11 and apertured and porous metal article 1 can be inserted in the cell. This can allow enhanced cell operating efficiency by permitting insertion of the apertured metal article 1 directly as an on-site installation in the field, without deleterious extension of cell down-time. After subsequent cell operation, upon dismantling of the cell, the apertured and porous metal article 1 typically will readily release from the separator member 12 and the electrode member 11, if the metal article 1 has not been secured, such as by welding into an installation unit during assembly.

Although the electrode member 11 has been depicted in FIG. 4 as a plate, when the electrode is an anode in an electrolytic cell, the anode may take various forms, e.g., the form of an expanded metal mesh, woven wire, or punched and pierced louvered sheet. The anode will generally be a metal anode and the metals of the anode will most always be valve metals, including titanium, tantalum, aluminum, zirconium and niobium. As well as unalloyed metal, the suitable metals of the anode assembly can include metal alloys and intermetallic mixtures.

The cathode may also be metallic and useful metals include nickel and steel including stainless steel, as well as valve metals such as titanium. The steel cathode may be nickel coated, e.g., nickel plated, when in contact with a nickel metal article 1. Other metal cathodes can be in intermetallic mixture or alloy form, such as iron-nickel alloy, or alloys with cobalt, chromium or molybdenum, or the metal of the cathode may essentially comprise nickel, cobalt, molybdenum, vanadium or manganese. The active electrode surface area of the cathodes and anodes can be uncoated, e.g., a bare, smooth nickel metal cathode. Alternatively, the active surface such as for the anodes can comprise a coated metal surface, such as a valve metal substrate having an electrocatalytic coating applied thereto. The coating can be a precious metal and/or oxides thereof, a transition metal oxide and mixtures of any of these materials, as will be more particularly discussed further on hereinbelow. The active surface for the cathode can be any cathode coating as would be contemplated as useful by those skilled in the art of electrolytic cells. Such might be a layer of, for example, nickel including activated nickel, nickel-molybdenum, nickel-zinc or an oxide thereof which might be present together with cadmium, or a precious metal such as platinum, palladium or ruthenium. Other metal-based cathode layers can be provided by alloys such as nickel-molybdenum-vanadium and nickel-molybdenum. Activated cathodes are well known and fully described in the art.

The electrode member 11 in FIG. 4 as a cathode member 11 may also be a foraminous structure. A typical foraminous metal electrode is an expanded metal, e.g., an electrode mesh with each diamond of mesh having an aperture of about one-sixteenth inch to one-quarter inch or more dimension for the short way of the design, while generally being about one-eighth to about one-half inch across for the long way of the design. The cathode electrode member may, however, be a perforated plate, or wire screening, or a punched and pierced louvered sheet or the like.

As has been mentioned hereinbefore, the apertured and porous metal article 1 in sheet form may comprise layers, such as of mesh and non-woven fabric sheets. Such a layered structure has been disclosed in U.S. Pat. No. 5,300,165. It is also contemplated that a layered structure could include precursor substrate materials such as of a sheet of coarse, very openly porous polymer foam which is layered in engagement with a layer of a finer polymer foam having a smaller pore size. As the word is used herein, a "coarse" polymer foam is merely a more openly porous foam, e.g., a foam of 10 ppi, as opposed to a "fine" polymer foam of smaller pores, such as a foam of 65 ppi. For such a material where, for example, sheets of these foams are layered together, the coarse polymer foam sheet can be such a sheet as would be the precursor material to the hereinabove described reticulated, very openly porous material having pore size ranging from about 5 to about 30 ppi. The layer of fine pore material can comprise a polymer foam sheet having a pore size ranging, for example, from about 40 to about 120 ppi. The sheet layers can be placed together and processed such as by coating with a latex graphite and then electroplating, all as has been described hereinabove, to provide a unitized porous metal article. That is, the porous metal article is a unit in layer form, with the layers being metallically bonded together during manufacture.

Prior to manufacture, the fine pore foam can have apertures provided therein. The resulting unitized article can thus have the layer of fine pore material as an apertured and porous metal article. In this unitized article, it is contemplated that the reticulated, very openly porous material may serve, such as in an electrolytic cell assembly 10 of FIG. 4, as an electrode member 11. For example, the more openly porous material layer may serve as at least part of the cathode of an electrolytic cell assembly 10. In this unitized structure, the apertured and porous metal article 1 is thus coupled with the electrode during manufacture, rather than the more typical manufacture of the article 1 as a free standing insert member. Such forming of this unitized structure from precursor materials may provide economic advantages in assembly.

The electrolytic cell assembly 10 of FIG. 4, and including a unitized article of electrode member 11 and apertured and porous metal article 1, can be incorporated, as by insertion, into an electrolyzer, such as the filter press electrolyzer shown in U.S. Pat. No. 4,738,763. The electrolyzers can be useful for the electrolysis of a dissolved species contained in a bath, such as in electrolyzers employed in a chlor-alkali cell to produce chlorine and caustic soda. The electrolyzers can also be useful in the recovery of chemical value such as potassium hydroxide, or chloric acid or sulfuric acid, e.g., by the electrolysis of salt solutions such as sodium chlorate and sodium sulfate. Other uses include electrolytic destruction of organic pollutants, water electrolysis, electro-regeneration of catalytic intermediates, electrolysis of sodium carbonate, and electrogeneration of hydrogen peroxide, persulfuric acid and other strong oxidants.

It is contemplated that the apertured and porous metal article can find use in an electrolytic cell provided with any of those porous separators as are known to be used in cells, and which include membranes and diaphragms as well as ceramic separators and the like. Membranes suitable for use as a separator member 12 can readily be of types which are commercially available. One presently preferred material is a perfluorinated copolymer having pendant cation exchange functional groups. These perfluorocarbons are a copolymer of at least two monomers with one monomer being selected from a group including vinyl fluoride, hexafluoropropylene, vinylidine fluoride, trifluoroethylene, chlorotrifluoroethylene, perfluoro (alkyvinyl ether), tetrafluoroethylene, and mixtures thereof.

The second monomer often is selected from a group of monomers usually containing an $SO_2F$ or sulfonyl fluoride pendent group. Examples of such second monomers can be generically represented by the formula $CF_2{=}CFR_1SO_1F$. $R_1$ in the generic formula is a bifunctional perfluorinated radical comprising generally one to eight carbon atoms, but upon occasion as many as twenty-five. One restraint upon the generic formula is general requirement for the presence of at least one fluorine atom on the carbon atom adjacent the $SO_2F$ group, particularly where the functional group exists as the —(—$SO_2NH$)mQ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Such perfluorocarbons generally are available commercially, such as through E. I. duPont, their products being known generally under the trademark NAFION. Perfluorocarbon copolymers containing perfluoro (3, 6-dioxa-4-methyl-7-octenesulfonyl fluoride) comonomer have found particular acceptance.

It is also contemplated that the separator member 12 can be a diaphragm, which may sometimes be referred to herein as a "diaphragm porous separator". For the diaphragm, a natural material such as asbestos fiber may be used in forming the diaphragm, or a synthetic material such as a synthetic fiber used in a synthetic, electrolyte permeable diaphragm can be utilized, or the diaphragm may be a combination of natural and synthetic material. The synthetic diaphragms generally rely on a synthetic polymeric material, such as polyfluoroethylene fiber as disclosed in U.S. Pat. No. 5,606,805 or expanded polytetrafluoroethylene as disclosed in U.S. Pat. No. 5,183,545. Such synthetic diaphragms can contain a water insoluble inorganic particular, e.g., silicon carbide, or zirconia, as disclosed in U.S. Pat. No. 5,188,712, or talc as taught in U.S. Pat. No. 4,606,805. Of particular interest for the diaphragm is the generally non-asbestos, synthetic fiber diaphragm containing inorganic particulates as disclosed in U.S. Pat. No. 4,853,101. The teachings of this patent are incorporated herein by reference.

Broadly, this diaphragm of particular interest comprises a non-isotropic fibrous mat wherein the fibers of the mat comprise 5–70 weight percent organic halocarbon polymer fiber in adherent combination with about 30–95 weight percent of finely divided inorganic particulates impacted into the fiber during fiber formation. The diaphragm has a weight per unit of surface area of between about 2 to about 12 kilograms per square meter. Preferably, the diaphragm has a weight in the range of about 3–7 kilograms per square meter. A particularly preferred particulate is zirconia. Other metal oxides, i.e., titania, can be used, as well as silicates, such as magnesium silicate and alumino-silicate, aluminates, ceramics, cermets, carbon, and mixtures thereof. Especially for this diaphragm of particular interest, the diaphragm may be compressed, e.g., at a compression of from about one to about six tons per square inch.

It is also contemplated that the separator member 12 as a membrane or a diaphragm in engagement with the perforated metal article 1 can have catalysts bonded to the separator member 12, in the manner of a coating associated therewith. Such catalysts as have been found useful for bonding to a membrane can include platinum black, ruthenium oxide, platinum-tin alloys and platinum on carbon. Separators of this nature have been taught in U.S. Pat. No. 5,470,449. In this arrangement, the porous metal article may or may not also have an electrochemically active coating, but is contemplated to typically not contain such an active coating. As representative of the electrochemically active coatings that have been mentioned hereinbefore such as may be applied to the apertured and perforated metal article 1, and are particularly useful when the article 1 is a valve metal article 1 and the electrode is an anode, are those provided from platinum or other platinum group metals or they can be represented by active oxide coatings such as platinum group metals, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings include tin oxide, manganese dioxide, lead dioxide, cobalt oxide, ferric oxide, platinate coatings such as $M_xPT_3O_4$ where M is an alkali metal and x is typically targeted at approximately 0.5, nickel—nickel oxide and nickel plus lanthanide oxides.

The following examples show ways in which the invention has been practiced but should not be construed as limiting the invention.

EXAMPLE 1

An open-cell polyurethane foam sheet having 65 ppi and a sheet thickness of 1.7 millimeters (mm.) was made conductive with a colloidal dispersion of carbon black in the manner described in U.S. Pat. No. 5,374,491. The sheet was then provided with a nickel electroplate coating in a process as described in the U.S. Pat. No. 4,978,431. The plated nickel sheet was washed and dried, subjected to thermal decomposition to remove the polyurethane foam substrate, and subsequently annealed, all in the manner as also described in the U.S. Pat. No. 4,978,431, to obtain a porous nickel foam sheet. The resulting reticulate nickel foam sheet had a network of open cell pores and continuously connecting strands. The strands had an average thickness of about 50 microns. The nickel sheet had a weight of about 490 grams per square meter ($g/m^2$), a cell count of 65 ppi and an average pore diameter, in microns, of about 390.

A 25 square inch sample of the resulting nickel foam sheet was perforated by punching an awl, 2 mm in diameter, through the sheet. By this method of perforation, the sample had a smooth, but not calendered, front face and a rough back face, the roughness being provided by the raised nickel reticulate strands projecting around the edges of the perforations on the back face. The perforations, all of the same configuration and size, were circular in cross-section and measured 2 mm. in diameter. They were located in a hexagonal pattern with spacing at 4 mm., center to center. There were 48 perforations per square inch of the front face of the test sample, providing 27% open area attributed to these perforations on the broad front face of such sheet.

The perforated nickel foam was provided with a coating of platinum and ruthenium metal at a coating weight of 7.67 $g/m^2$. The coating was applied from a chloride solution containing chloroplatinic acid. The coating permeated through, and coated the entire surface area of, the foam.

The perforated and coated porous nickel foam was tested in a laboratory bench cell assembled in accordance with the teachings of U.S. Pat. No. 4,738,763. The assembly had a titanium anode with dimensionally stable coating and a 5¾ inch square expanded nickel mesh. The cell utilized a NAFION (registered trademark) membrane separator between the anode and the cathode. The anode and cathode were oriented to directly oppose one another with the membrane therebetween. The perforated and reticulated nickel foam sheet was inserted between, i.e., sandwiched between, the cathode and the membrane. The smooth side of the foam sheet was pressed against, and thereby engaged, the membrane and the rough side was pressed against, and thereby engaged, the cathode, in the manner as shown in FIG. 4. The cell was operated continuously at about 95° C. and at a current density of about 3.5 kilo amperes per square meter. The catholyte was 33 weight percent NaOH and the anolyte was 200 grams per liter of NaCl which was continuously circulated. The cell was operated for four weeks with absolutely no difficulty or sign of instability of any kind. During this test, 2.95 volts was obtained indicating highly desirable voltage savings. Comparatively, a non-perforated nickel foam sheet test sample with the platinum and ruthenium metal coating showed no voltage savings in the bench cell test. Furthermore, this savings for the perforated and coated test sheet was achieved in combination with desirable caustic current efficiency.

At the end of the test, the cell was disassembled. The perforated and coated nickel foam was readily separated from both the membrane and the cathode. The membrane was seen by visual inspection to be free from perforations or any unusual surface irregularities. The coated nickel foam, also as viewed by visual inspection, was found to be in the same condition as when inserted in the test cell as assembled. The cathode was also judged by similar inspection to be in pre-assembly condition.

EXAMPLE 2

The same perforated nickel foam, prepared as described in Example 1, was provided with a coating of platinum and ruthenium metal at a coating weight of 7.67 g/m$^2$. The coating was applied by dip coating a solution of platinum and ruthenium chlorides onto the perforated nickel foam followed by curing at room temperature. The coating uniformly coated the entire surface of the foam.

The perforated, porous nickel foam sheet was tested in a laboratory bench cell sized and assembled as in Example 1. However, the cell had a woven wire cathode of carbon steel wires. The anode and cathode of the cell were oriented to directly oppose one another, but had a diaphragm therebetween. The nickel foam was inserted between, i.e., sandwiched between, the cathode and the diaphragm. To do this, a diaphragm was deposited on the smooth side of the nickel foam sheet. The deposited diaphragm utilized the zirconia and polytetrafluoroethylene fiber described in U.S. Pat. No. 4,853,101 and the deposit was made in the manner of Example 1 of the patent. After applying against the cathode, the foam sheet, with diaphragm, was wetted for about 12 hours in a Zonyl (trademark) nonionic fluorosurfactant and dried for about 12 hours at 180° F. The rough side of the foam sheet was pressed against the cathode. The cell was operated continuously at about 95° C. and at a current density of about 1.5 kilo amperes per square meter. The catholyte was 12 weight percent NaOH and the anolyte was 280 grams per liter of NaCl. The cell was operated for 12 weeks with absolutely no difficulty or sign of instability of any kind. During this test, the results included voltage savings of 20 to 300 millivolts (mV), lower cell liquor chlorates and lower cell hydrogen gas.

EXAMPLE 3

The same perforated nickel foam, prepared as described in Example 1, was provided with a coating of nickel and zinc metal at a coating weight of 1.1 kilograms per square meter (kg/m$^2$). The coating was applied by electroplating a solution of nickel and zinc chlorides onto the perforated nickel foam. Then, the zinc was leached from the metallized foam with an aqueous solution of 10% by weight of NaOH. The resulting coating of high surface area nickel was applied uniformly throughout the foam.

The perforated and coated porous nickel foam was tested in the laboratory bench cell described in Example 2. The anode and cathode were oriented to directly oppose one another with the diaphragm therebetween. The perforated and reticulated nickel foam sheet was inserted between, i.e., sandwiched between, the cathode and the diaphragm. The smooth side of the foam sheet was pressed against the diaphragm and the rough side against the cathode. The cell was operated continuously in the manner as described in Example 2. The cell was operated for 12 weeks with absolutely no difficulty or sign of instability of any kind. During this test, the results included voltage savings of 20 to 300 mV.

EXAMPLE 4

The same perforated nickel foam, prepared as described in Example 1, was provided with a coating of activated nickel metal at a coating weight of 48 g/m$^2$. The coating was applied by fusing the aluminum as a sheet in foil form into the porous nickel foam at a temperature of 660° C. The aluminum was then leached from the foam with 15 weight percent NaOH. The coating permeated throughout the foam.

The perforated and coated porous nickel foam was tested in the laboratory bench cell described in Example 2. The anode and cathode were oriented to directly oppose one another with the diaphragm therebetween. The perforated and reticulated nickel foam sheet was sandwiched between the cathode and the diaphragm. The smooth side of the foam sheet was pressed against the diaphragm and the rough side against the cathode. The cell was operated continuously at about 95° C. and at a current density of about 1.5 kilo amperes per square meter. The catholyte was 12 weight percent NaOH and the anolyte was 280 grams per liter of NaCl. The cell was operated for eight weeks with absolutely no difficulty or sign of instability of any kind.

EXAMPLE 5

The same nickel foam sheet, but unperforated, prepared as described in Example 1, was provided with a coating of platinum and ruthenium metal at a coating weight of 7.67 g/m$^2$ of platinum. The coating was applied in the manner as described in Example 2 and resulted in the coating as described in Example 2. Being unperforated, this sheet is a "control" and is identified in the Table below as the "Pt/Ru Control".

The same nickel foam sheet, also unperforated, prepared as described in Example 1 was provided with an activated nickel coating at a nickel coating weight of 1.09 kg/m$^2$. The coating was obtained by the electroplating and leaching procedure as described in Example 3. Owing to the foam sheet being unperforated, it was also employed as a control. It is identified in the Table below as the "Ni/Zn Control."

Each of these coated, but unperforated, porous nickel foam sheets was tested in a laboratory bench cell as described in Example 2. The anode and cathode of the cell were oriented to directly oppose one another with the diaphragm therebetween. Each nickel foam sheet was inserted between, i.e., sandwiched between the cathode and the diaphragm of its own test cell. Each was then pressed against a cathode in a cell. The cells were operated continuously under conditions as noted in the Table below. All operating results are also reported in the Table.

One laboratory bench cell, sized and assembled as described in Example 1, was used as an additional control. It is identified in the Table below simply as the "Control." The cell had the same diaphragm as above described, but the diaphragm was applied in the manner as above described to the woven wire cathode of carbon steel wires. This Control cell had no foam sheet. The cell was operated continuously in the manner as presented in the Table below, and the operating results obtained are reported in the Table.

The same perforated nickel foam sheet, prepared as described in Example 1, was provided with a coating of platinum and ruthenium metal at a coating weight of 7.67 g/m$^2$. The coating was applied in the manner of Example 2 and resulted in the coating as described in Example 2. This sheet, being perforated, is identified in the Table below as "Pt/Ru Invention."

The same perforated nickel foam sheet, prepared as described in Example 1, was provided with an activated nickel coating at a nickel coating weight of 1.09 kilograms per square meter (kg/m$^2$). The coating was obtained by the electroplating and leaching procedure as described in Example 3. This perforated invention sheet is identified in the Table below as "Ni/Zn Invention."

Each perforated and coated porous nickel foam sheet was tested in the laboratory bench cell described in Example 1. The cell assembly was as described hereinabove. These foam sheets were perforated to have a rough side and a smooth side. The smooth side of the foam sheet had the diaphragm applied thereto. It was the same diaphragm as above described and it was applied in the same manner as described hereinabove. The rough side of each foam sheet was pressed against the cathode. The cell was operated continuously and operating results were obtained, all in the manner as presented in the Table below.

TABLE

| FOAM SHEET | DAYS ON LINE | CELL VOLTS* 1ASI | CCE* % | $ClO_3$ (gpl) | $H_2$% |
|---|---|---|---|---|---|
| Control | 98 | 3.08 | 91.1 | .37 | .22 |
| Ni/Zn Control | 93 | 3.06 | 90.4 | .24 | N.M. |
| Ni/Zn Invention** | 98 | 2.95 | 94.4 | .17 | .085 |
| Pt/Ru Control** | 100 | 3.03 | 92.7 | .09 | N.M. |
| Pt/Ru Invention** | 98 | 2.99 | 94.75 | .065 | .175 |

N.M. = Not Measured.
*1ASI (amps per square inch) = 6.45 amps per square centimeter.
CCE = Cathode Current Efficiency.
gpl = grams per liter
**Average of two cells

We claim:

1. An apertured and porous metal article, which article is a three dimensional reticulated metal article consisting of a network of pores and interconnecting pore boundary material, said article having, in addition to the porosity of the pores within the article, a multitude of apertures through the article, which apertures through the article are enlarged over the size of said pores within the article where said article is in sheet form having front and back major faces, wherein one of said front and back major faces is an at least substantially smooth major face, and the other major face is an at least substantially rough major face.

2. The metal article of claim 1 wherein said pores are open-cell, interconnecting pores and said pore boundary material comprises continuously connected material providing open pore sides for interconnection of said pores.

3. The metal article of claim 2 wherein said boundary material provides thin, interconnecting pore walls, having a thickness in the range of from about 10 microns to about 120 microns.

4. The metal article of claim 2 wherein said boundary material comprises continuously connected strands.

5. The metal article of claim 1 wherein said pores within said article are small pores having a longest internal pore dimension that is shorter than the shortest dimension for said apertures, which longest internal dimension for said small pores is within the range of from about 200 microns to about 500 microns, and which shortest dimension for said apertures is within the range of from about 0.5 mm to about 5 mm.

6. The metal article of claim 5 wherein the ratio of the shortest dimension for said apertures through the article to the longest internal dimension for said small pores within the article is in the range from about 1:1 to about 5:1.

7. The metal article of claim 1 wherein said three dimensional metal article is a foam having at least one lineal dimension containing from about 5 to about 120 pores per inch.

8. The metal article of claim 1 wherein said three dimensional article has a face containing from about 30 to about 100 apertures per square inch of said article face.

9. The metal article of claim 1 wherein said apertures through said article all have at least substantially the same configuration and are all at least substantially the same size.

10. The metal article of claim 9 wherein said apertures at their periphery are all at least substantially rounded and have a diameter within the range of from about 1 mm to about 10 mm.

11. The metal article of claim 1 wherein said article is in sheet form, said sheet has front and back major faces, and said sheet has a thickness in the range of from about 0.1 mm to about 10 mm.

12. The metal article of claim 11 wherein said sheet has from about 40 to about 120 pores per inch and has a sheet thickness in the range of from about 1.5 mm to about 3 mm., or said sheet has from about 5 to about 30 pores per inch and has a sheet thickness in the range of from about 5 mm to about 10 mm.

13. The metal article of claim 11 wherein each major face of said article has apertures providing from about 10% to about 75% of open area on said face, basis total area of said face.

14. The metal article of claim 11 wherein said smooth major face has a calendered surface.

15. The metal article of claim 11 wherein said apertures are punched hole perforations that are rough around each perforation edge on said rough major face and smooth around each perforation edge on said smooth major face.

16. The metal article of claim 11 wherein said sheet is flexible and is in coiled form.

17. The metal article of claim 1 wherein said metal article is coated with a metal.

18. The metal article of claim 17 wherein said coating is an asymmetric coating and said asymmetric coating is present on said article in an amount within the range from about 2 to about 2,500 grams of coating per square meter of a face of said three dimensional article.

19. The metal article of claim 18 wherein said metal article is coated in situ in an electrolytic cell by plating metal ions, in metallic form, on said article while said article is present in an electrolytic cell and said metal ions are present in electrolyte in said cell.

20. The metal article of claim 19 wherein said article coated in situ in said cell is coated with an electrocatalytic coating containing a platinum group metal and the resulting coated article is retained in said cell during cell operation.

21. The metal article of claim 17 wherein said metal article is coated in a continuous process and said process comprises applying liquid coating composition on said article utilizing gravure roller application.

22. The metal article of claim 17 wherein said coating is an electrocatalytic coating, and said electrocatalytic coating contains a platinum group metal, or metal oxide or their mixtures.

23. The metal article of claim 22 wherein said electrocatalytic coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel-nickel oxide or a mixture of nickel plus lanthanum oxides.

24. The metal article of claim 17 wherein said article engages a cathode in an electrolytic cell, said article is coated with one or more of platinum metal, ruthenium metal, or activated nickel metal, and said activated nickel metal is provided from nickel-aluminum which is in a form selected from the group consisting of nickel-aluminum alloy, intermetallic mixture, or nickel-aluminum compound.

25. The metal article of claim 1 wherein the metal of said article is electroplated metal, said electroplated metal is plated on a reticulated foam substrate material and said electroplated metal is subjected to heat treatment.

26. The metal article of claim 1 wherein the metal of said article is a metal selected from the group consisting of nickel, chromium, zinc, copper, tin, titanium, lead, iron, gold, silver, platinum, palladium, rhodium, aluminum, cadmium, cobalt, indium, vanadium, thallium and gallium, their alloys and intermetallic mixtures.

27. The metal article of claim 1 wherein the metal of said article is titanium that is vapor deposited on a copper or nickel metal substrate and said article engages an anode, or serves as an anode, in an electrolytic cell.

28. An electrode for serving as an anode or cathode of an electrolytic cell and comprising the apertured and porous metal article of claim 1.

29. The electrode of claim 28 wherein said electrode is a nickel metal anode in an electrolytic cell for water electrolysis.

30. An electrolytic cell having an electrode in the cell in engagement with the apertured and porous metal article of claim 1.

31. A current collector comprising the apertured and porous metal article of claim 1.

32. The method of preparing a metal article, which article is a three dimensional reticulated metal article consisting of a network of pores and interconnecting pore boundary material, said article having, in addition to the porosity of the pores within the foam, a multitude of apertures through the metal article, which apertures through the article are enlarged over the size of said pores within the foam, which method comprises:

(1) establishing a three dimensional precursor article of open-pore substrate material having continuously connecting pore boundary material wherein said article is in sheet form having front and back major faces;

(2) providing apertures through said precursor article, which apertures are enlarged in size over the size of said pores within said substrate material; and wherein one of said front and back major faces is an at least substantially smooth major face, and the other major face is an at least substantially rough major face; and (3) metallizing said substrate material of said precursor article, preparing an apertured, three dimensional reticulated porous metal article;

with the proviso that said metallizing of step (3) may precede said providing of large apertures of step (2).

33. The method of claim 32 wherein there is established a three dimensional non-metallic precursor article and said article has pores in at least one lineal dimension within the range of from about 5 to about 120 pores per inch.

34. The method of claim 32 wherein said metallizing is conducted at least in part in a metal electroplating bath.

35. The method of claim 32 wherein said reticulated porous metal article is heated at a temperature within the range from about 800° C. to about 1200° C. after said metallizing.

36. The method of claim 32 wherein said apertures in said article are provided by perforating said apertures through said article.

37. The method of claim 36 wherein said reticulated porous metal article is perforated by punching holes through said article.

38. The method of claim 37 wherein said metallizing includes providing a copper or nickel porous metal article and vapor depositing titanium on said copper or nickel article.

39. An apertured and porous metal anode made by the method of claim 38.

40. The method of claim 32 wherein said reticulated porous metal article is provided with apertures through said article which have a shortest dimension which is longer than the longest dimension for a pore within said article.

41. The method of claim 32 wherein said apertured and porous metal article is coated with a metal.

42. The method of claim 41 wherein said metal article is coated in situ in an electrolytic cell by plating metal ions, in metallic form, on said article while said article is present in an electrolytic cell and said metal ions are present in electrolyte in said cell.

43. The method of claim 42 wherein said article coated in situ in said cell is coated with an electrocatalytic coating containing a platinum group metal and the resulting coated article is retained in said cell during cell operation.

44. The method of claim 41 wherein said coating is an asymmetric coating and said asymmetric coating is present on said article in an amount within the range from about 2 to about 2,500 grams of coating per square meter of a face of said three dimensional article.

45. The method of claim 41 wherein said metal article is coated in a continuous process by applying liquid coating composition on said article utilizing gravure roller application.

46. The method of claim 41 wherein said apertured and porous metal foam article is coated with an electrocatalytic coating and said electrocatalytic coating contains a platinum group metal, or metal oxide or their mixtures.

47. The method of claim 46 wherein said electrocatalytic coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel—nickel oxide or a mixture of nickel plus lanthanum oxides.

48. The method of claim 46 wherein said article engages a cathode in an electrolytic cell, said article is coated with one or more of platinum metal, ruthenium metal, or activated nickel metal, and said activated nickel metal article is provided from a metal article of nickel aluminum which is in a form selected from the group consisting of nickel—aluminum alloy, intermetallic mixture, or nickel—aluminum compound.

49. An apertured and porous metal electrode, as anode or cathode, made by the method of claim 32.

50. The electrode of claim 49 wherein said electrode is an anode in an electrolytic cell for water electrolysis.

51. An electrolytic cell having an electrode in the cell in engagement with an apertured and porous metal article made by the method of claim 32.

52. An electrolytic cell comprising a separator member arranged between anode and cathode electrode members, characterized in that said separator member is in contact on at least one broad surface thereof with an apertured and porous metal article, which article is a three dimensional reticulated metal article consisting of a network of pores and interconnecting pore boundary material, said article having, in addition to the porosity of the pores within the article, a multitude of apertures through the article, which apertures through the article are enlarged over the size of said pores within the article.

53. The electrolytic cell of claim 52 wherein said apertured and porous metal article has open-cell, interconnecting pores and said pore boundary material has continuously connecting material providing open pore sides for interconnection of said pores.

54. The electrolytic cell of claim 52 in which the apertured and porous metal article is sandwiched between the cathode and the separator member of the cell.

55. The electrolytic cell of claim 54 wherein gas is released at said cathode, said apertures have at least substantially rounded upper edges and gas releases from said cathode past said upper rounded aperture edges.

56. The electrolytic cell of claim 52 wherein said three dimensional metal article has at least one lineal dimension containing from about 5 to about 120 pores per inch.

57. The electrolytic cell of claim 52 wherein said three dimensional article has a face containing from about 30 to about 100 apertures per square inch of said article face.

58. The electrolytic cell of claim 52 wherein said apertures in said article all have at least substantially the same configuration and are all at least substantially the same size.

59. The electrolytic cell of claim 58 wherein said apertures are all at least substantially rounded at their periphery and have a diameter within the range of from about 1 mm to about 10 mm.

60. The electrolytic cell of claim 52 wherein said separator member and said article are both in sheet form, each sheet has front and back major faces, and said article in sheet form has a thickness in the range of from about 0.1 mm. to about 10 mm.

61. The electrolytic cell of claim 60 wherein said separator member is in contact on at least one major face with a major face of said article.

62. The electrolytic cell of claim 60 wherein one of said front and back major faces of said article is an at least substantially smooth major face, and the other is an at least substantially rough major face and said rough major face is in contact with an electrode member and said smooth major face is in contact with said separator member.

63. The electrolytic cell of claim 52 wherein one or more of said article and said electrode members is coated with a metal.

64. The electrolytic cell of claim 63 wherein said coating is an asymmetric coating and said asymmetric coating is present on said article in an amount within the range from about 2 to about 2,500 grams of coating per square meter of a face of said three dimensional article.

65. The electrolytic cell of claim 64 wherein said article coated in situ in said cell is coated with an electrocatalytic coating containing a platinum group metal and the resulting coated article is retained in said cell during cell operation.

66. The electrolytic cell of claim 63 wherein said metal article is coated in situ in said electrolytic cell by plating metal ions, in metallic form, on said article while said article is present in such electrolytic cell and said metal ions are present in electrolyte in said cell.

67. The electrolytic cell of claim 63 wherein said metal article is coated in a continuous process and said process comprises applying liquid coating composition on said article utilizing gravure roller application.

68. The electrolytic cell of claim 63 wherein said coating is an electrocatalytic coating and said electrocatalytic coating contains a platinum group metal, or metal oxide or their mixtures.

69. The electrolytic cell of claim 68 wherein said electrocatalytic coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel—nickel oxide or a mixture of nickel plus lanthanum oxides.

70. The electrolytic cell of claim 63 wherein the metal of said article engages a cathode in an electrolytic cell, said article is coated with one or more of platinum metal, ruthenium metal, or activated nickel metal and said activated nickel metal is provided from nickel—aluminum which is in a form selected from the group consisting of nickel—aluminum alloy, intermetallic mixture, or nickel—aluminum compound.

71. The electrolytic cell of claim 52 wherein said electrode members include a valve metal anode and said valve metal is selected from the group consisting of titanium, tantalum, niobium and zirconium, their alloys and intermetallic mixtures.

72. The electrolytic cell of claim 52 wherein said electrode member is a metal cathode and said metal of said cathode is one or more of nickel, cobalt, molybdenum, vanadium, or manganese or alloys or intermetallic mixtures thereof, or steel including stainless steel.

73. The electrolytic cell of claim 52 wherein said apertured and porous metal article is compressively urged into direct contact with said separator member and said separator member is a membrane or diaphragm porous separator member.

74. The electrolytic cell of claim 73 wherein said membrane or diaphragm porous separator member has catalyst bonded thereto.

75. The electrolytic cell of claim 73 wherein said apertured and porous metal article is readily separable from said separator member on pressure release.

76. The electrolytic cell of claim 73 wherein said diaphragm contains one or more of a natural or synthetic material and said diaphragm as a synthetic diaphragm comprises organic polymer fibers in adherent combination with inorganic particulates that comprises a non-isotropic fibrous mat comprising 5–70 weight percent of halocarbon polymer fiber in adherent combination with about 30–95 weight percent of finely divided inorganic particulates.

77. The electrolytic cell of claim 52 having said apertured and porous metal article present therein as a removable insert.

78. The method of refurbishing an electrolytic cell having a separator member arranged between anode and cathode electrode members, which method comprises:

(1) separating said separator member within said cell from at least one electrode member contained within said cell;

(2) inserting between the resulting separated electrode member and separator member, an apertured and porous metal article, which article is a three dimensional reticulated metal article consisting of a network of pores and interconnecting pore boundary material, said article having, in addition to the porosity of the pores within the article, a multitude of apertures through the article, which apertures through the article are enlarged over the size of said pores within the article; and (3) engaging said separator member and said electrode member with said apertured and porous metal article positioned therebetween.

79. A unitized porous metal article in sheet form having a reticulated, very openly porous layer free from apertures through the layer, which layer is metallically bonded to an apertured and porous metal layer of fine porous material, each layer consisting of a network of pores and interconnecting pore boundary material, with said apertured and porous metal layer having apertures through the layer enlarged over the size of the fine pores within the layer.

80. The metal article of claim 79 wherein said very openly porous layer has pore size ranging from about 5 to about 30 ppi and said fine porous layer has pore size ranging from about 40 to about 120 ppi.

81. The metal article of claim 79 wherein said very openly porous layer has a thickness in the range from about 5 mm to about 10 mm and said fine porous layer has a thickness in the range from about 1.5 mm to about 3 mm.

82. The metal article of claim 79 wherein said article engages a cathode in an electrolytic cell, said article is coated with one or more of platinum metal, ruthenium metal, or activated nickel metal and said activated nickel metal is provided from nickel—aluminum which is in a form selected from the group consisting of nickel—aluminum alloy, intermetallic mixture, or nickel—aluminum compound.

83. The metal article of claim 79 wherein said metal article is coated in a continuous process by applying liquid coating composition on said article utilizing gravure roller application.

84. The metal article of claim 79 wherein the metal of said article is electroplated metal, said electroplated metal is plated on a reticulated foam substrate material and said electroplated metal is subjected to heat treatment.

85. The metal article of claim 79 wherein the metal of said article is a metal selected from the group consisting of nickel, chromium, zinc, copper, tin, titanium, lead, iron, gold, silver, platinum, palladium, rhodium, aluminum, cadmium, cobalt, indium, vanadium, thallium and gallium, their alloys and intermetallic mixtures.

86. The metal article of claim 79 wherein the metal of said article is titanium that is vapor deposited on a copper or nickel metal substrate and said article engages an anode, or serves as an anode, in an electrolytic cell.

87. An electrode for serving as an anode or cathode of an electrolytic cell and comprising the apertured and porous metal article of claim 79.

88. The electrode of claim 87 wherein said electrode is a nickel metal anode in an electrolytic cell for water electrolysis.

89. A current collector comprising the apertured and porous metal article of claim 79.

90. A unitized article in sheet form having a separator member for an electrolytic cell formed on an apertured and porous metal article, which metal article is a three dimensional reticulated metal article consisting of a network of pores and interconnecting pore boundary material, said metal article having, in addition to the porosity of the pores within the article, a multitude of apertures through the article, which apertures through the article are enlarged over the size of said pores within the article.

91. The unitized article of claim 90 wherein said separator member is a diaphragm separator which is directly deposited on said apertured and porous metal article.

92. The unitized article of claim 91 wherein said diaphragm contains one or more of a natural or synthetic material and said diaphragm as a synthetic diaphragm comprises organic polymer fibers in adherent combination with inorganic particulates, which diaphragm comprises a non-isotropic fibrous mat comprising 5–70 weight percent of halocarbon polymer fiber in adherent combination with about 30–95 weight percent of finely divided inorganic particulates.

93. The unitized article of claim 90 wherein said apertured and porous metal article has a coating and/or said separator member has a coating associated therewith.

94. The unitized article of claim 93 wherein said coating is an asymmetric coating and said asymmetric coating is present on said article in an amount within the range from about 2 to about 2,500 grams of coating per square meter of a face of said three dimensional article.

95. The unitized article of claim 93 wherein said metal article is coated in situ in an electrolytic cell by plating metal ions, in metallic form, on said article while said article is present in an electrolytic cell and said metal ions are present in electrolyte in said cell.

96. The unitized article of claim 95 wherein said article coated in situ in said cell is coated with an electrocatalytic coating containing a platinum group metal and the resulting coated article is retained in said cell during cell operation.

97. The unitized article of claim 93 wherein said metal article is coated in a continuous process by applying liquid coating composition on said article utilizing gravure roller application.

98. The unitized article of claim 93 wherein either or both of said coatings is an electrocatalytic coating and said electrocatalytic coating contains a platinum group metal, or metal oxide or their mixtures.

99. The unitized article of claim 98 wherein said electrocatalytic coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel—nickel oxide or a mixture of nickel plus lanthanum oxides.

100. The unitized article of claim 93 wherein said article engages a cathode in an electrolytic cell, said article is coated with one or more of platinum metal, ruthenium metal, or activated nickel metal, and said activated nickel metal is provided from nickel—aluminum which is in a form selected from the group consisting of nickel—aluminum alloy, intermetallic mixture, or nickel—aluminum compound.

* * * * *